US005467509A

United States Patent [19]

Fukushima

[11] Patent Number: 5,467,509

[45] Date of Patent: Nov. 21, 1995

[54] HOOK-AND-EYE FASTENER

[75] Inventor: Jukichi Fukushima, Namerikawa, Japan

[73] Assignee: Yoshida Kogyo K.K., Tokyo, Japan

[21] Appl. No.: 190,530

[22] Filed: Feb. 2, 1994

[30] Foreign Application Priority Data

Feb. 8, 1993 [JP] Japan ..... 5-043232

[51] Int. Cl.[6] ..... A44B 13/00

[52] U.S. Cl. ..... 24/689; 24/698.2

[58] Field of Search ..... 24/698.2, 698.1, 24/689, 690, 703, 4, 94, 95, 714.4, 715, 689, 690, 698.2

[56] References Cited

U.S. PATENT DOCUMENTS

| | | | |
|---|---|---|---|
| 1,378,108 | 5/1921 | Hart et al. | 24/94 |
| 1,463,236 | 7/1923 | White | 24/95 |
| 4,521,943 | 6/1985 | Kanzaka | 24/689 |
| 4,639,983 | 2/1987 | Fukuroi et al. . | |

FOREIGN PATENT DOCUMENTS

| | | | |
|---|---|---|---|
| 0103890 | 3/1984 | European Pat. Off. . | |
| 1102668 | 3/1961 | Germany . | |
| 4-112612 | 9/1992 | Japan . | |
| 862852 | 3/1961 | United Kingdom . | |
| 942269 | 11/1963 | United Kingdom | 24/689 |
| 2055286 | 3/1981 | United Kingdom | 24/689 |

*Primary Examiner*—James R. Brittain

*Attorney, Agent, or Firm*—Hill, Steadman & Simpson

[57] ABSTRACT

A hook-and-eye fastener comprises fastener members including a hook and an eye, each member having a pair of engaging prongs projecting substantially perpendicularly therefrom, and retainers adapted severally to immobilize the fastener members and intended to be disposed on the side of a fabric opposite to the side thereof on which the fastener members are set in place. Each of the retainers has a pair of thin-wall parts adapted to be pierced by the pair of engaging prongs of the relevant fastener member, and leading ends of the engaging prongs of each fastener member are formed in the shape of a flat part lying in a plane substantially perpendicular to a direction of penetration of the engaging prongs into the thin-wall parts of the relevant retainer.

11 Claims, 3 Drawing Sheets

HOOK-AND-EYE FASTENER

BACKGROUND OF THE INVENTION

1. Field of the Invention

This invention relates to a hook-and-eye fastener having a recurved hook and used for fastening together two pieces of a garment such as trousers and skirts.

2. Description of the Prior Art

The conventional hook-and-eye fasteners, as disclosed in U.S. Pat. No. 4,639,983 issued to Fukuroi et al. on Feb. 3, 1987, comprise a recurved hook made of brass, an eye made of brass and adapted to have the hook caught thereon, and retainers made of brass, adapted severally to fix the hook and the eye, and disposed on the side of a fabric opposite to the side thereof on which the hook and the eye are seated. The hook and the eye are each provided integrally with a pair of engaging prongs adapted to be fixed in the relevant retainers. The retainers severally have formed therein a pair of through holes adapted to be inserted thereinto by the pair of engaging prongs. The fixation of the hook and the eye to the fabric is accomplished by positioning the retainers on the opposite side of the fabric, inserting the engaging prongs of the hook and the eye through the fabric into the through holes of the retainers, and then bending the engaging prongs inwardly toward each other thereby joining the hook and the eye infallibly to the respective retainers. Incidentally, the leading end parts of the engaging prongs are formed in a sharply pointed acute angle shape as indicated by a two-dot chain line in FIG. 4 so as to facilitate the penetration of the engaging prongs through the fabric.

In the prior art hook-and-eye fastener described above, the insertion of the engaging prongs into the through holes of the retainers entails the problem that the engaging prongs having sharply pointed leading terminals force their way between adjacent component threads of the fabric while dragging the fabric into the through holes and leaving wrinkles behind in the fabric around the sites of insertion. Further, the insertion of the engaging prongs into tile through holes poses the problem that the leading end parts of the engaging prongs catch hold of threads of the fabric while piercing the fabric, drag the threads in the longitudinal and lateral direction of the fabric in the parts of the insertion of the engaging prongs and, as a result, impart a distortion to the pattern of the fabric in the parts in which the drag of threads has taken place and gather longitudinal and lateral wrinkles in the affected parts of the fabric.

For the purpose of restraining this phenomenon of the dragging of threads, hook-and-eye fasteners which have through holes in the retainers covered with a thin plate of aluminum as disclosed in published Japanese Utility Model Application, KOKAI (Early Publication) No. HEI 4-112,612 have been proposed to the art. In this case, when the engaging prongs are inserted into the through holes, the fabric is dragged into the through holes with difficulty because the thin plate holds the fabric in place. In this case, however, the separate thin plate covering the through holes is inevitably applied to the retainers. Thus, these hook-and-eye fasteners entail the problem that the number of component parts increases and the process of manufacture gains in complexity proportionately. Moreover, they still entail the problem that the sharply pointed leading end parts of the engaging prongs catch hold of threads of the fabric and drag them into the through holes. Similarly to those of the former version described above, these hook-and-eye fasteners tend to impart wrinkles to the fabric during the insertion of the engaging prongs.

SUMMARY OF THE INVENTION

It is therefore an object of the present invention to provide a hook-and-eye fastener which attains the attachment of a hook and an eye across a fabric to their respective retainers without either entailing the dragging of threads or leaving wrinkles behind in the fabric after the attachment.

According to the present invention, there is provided a hook-and-eye fastener comprising: fastener members comprising a hook and an eye, each member having a pair of engaging prongs projecting substantially perpendicularly therefrom; and retainers adapted severally to immobilize the fastener members and intended to be disposed on the side of a fabric opposite to the side thereof on which the fastener members are set in place. In the hook-and-eye fastener according to the present invention, each of the retainers has a pair of thin-wall parts adapted to be pierced by the pair of engaging prongs of the relevant fastener member, and the leading ends of the engaging prongs of each fastener member are formed in the shape of a flat part lying in a plane substantially perpendicular to a direction of penetration of the engaging prongs into the thin-wall parts of the relevant retainer.

In the attachment of the hook-and-eye fastener according to the present invention to a fabric, the engaging prongs of each fastener member are so positioned that the flat parts at the leading ends thereof remain in surface contact across the fabric with the thin-wall parts of the relevant retainer and the engaging prongs in the state mentioned above are pushed to pierce the thin-wall parts of the retainer. Owing to this arrangement, the fabric is cut in the plane or line of contact between the flat parts at leading ends of the engaging prongs and the thin-wall parts of the retainer then the engaging prongs collide against and pierce the thin-wall parts of the retainer. Subsequently, when the engaging prongs are farther inserted into the through holes consequently formed in the thin-wall parts of the retainer, they neither catch hold of threads of the fabric and drag them into the through holes nor gather wrinkles in the fabric around the sites of their fixation.

In carrying out the present invention in one preferred mode, to easily form the thin-wall parts in the retainer and allow the leading ends of the engaging prongs of each fastener member to pierce the thin-wall parts of the relevant retainer, the fastener members are made of a metal, preferably brass, and the retainers are made of aluminum or aluminum alloy. Preferably each of the engaging prongs of the fastener members has a free end part configured as a truncated wedge whose leading end face is formed in a flat surface substantially perpendicular to a longitudinal direction thereof.

BRIEF DESCRIPTION OF THE DRAWINGS

Other objects, features, and advantages of the invention will become apparent from the following description taken together with the drawings, in which.

DETAILED DESCRIPTION OF THE PREFERRED EMBODIMENT

Figure 1:
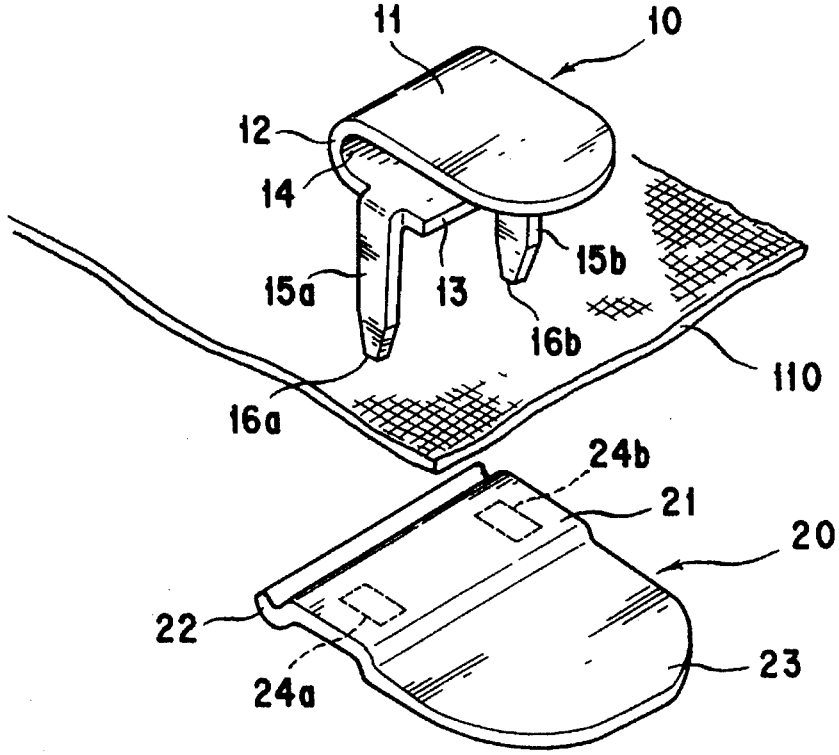
FIG. 1 is a perspective view illustrating one embodiment of a hook and a retainer of the hook-and-eye fastener according to the present invention in the state ready for fixation.
Figure 2:
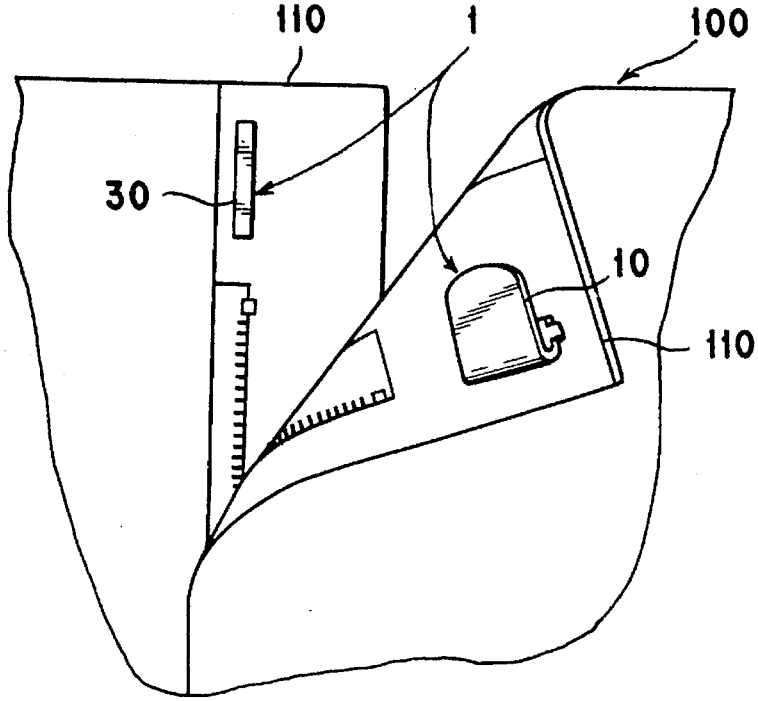
FIG. 2 is a perspective view illustrating the hook-and-eye fastener of the same embodiment in the state of actual use.
Figure 4:
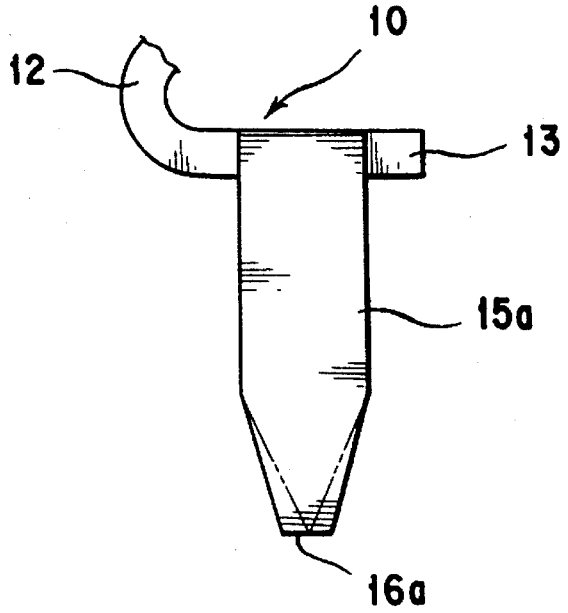
FIG. 4 is an enlarged fragmentary side view showing an engaging prong in the hook of the hook-and-eye fastener of the same embodiment.
Figure 5:
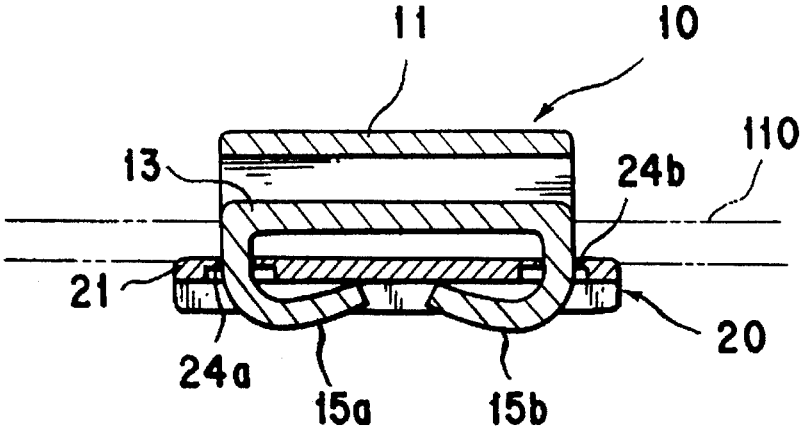
FIG. 5 is a cross sectional view illustrating an assembly of the hook and the retainer attached to the fabric.
Figure 6:
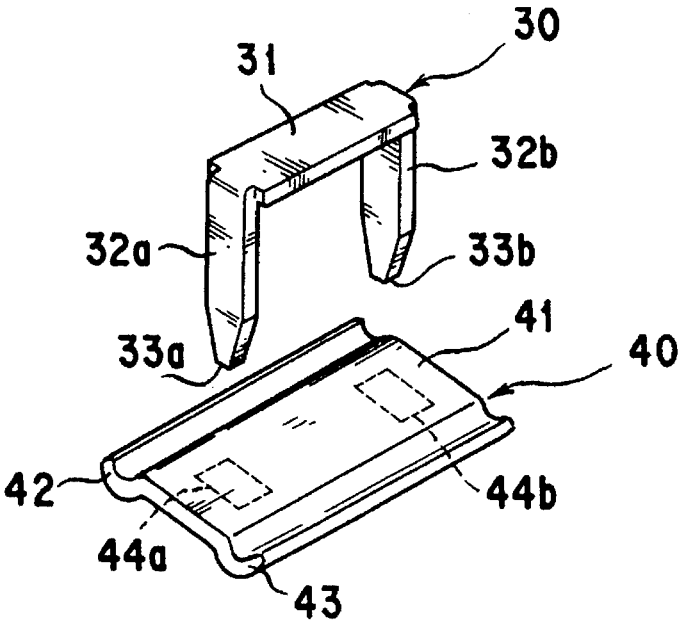
FIG. 6 is a perspective view illustrating one embodiment of an eye and a retainer of the hook-and-eye fastener according to the present invention.

FIG. 1 through FIG. 6 show a hook-and-eye fastener which is intended to be used in an opening part as in trousers or a skirt 100. As shown in FIG. 2, the hook-and-eye fastener 1 comprises a recurved hook 10 made of brass and an eye or companion loop 30 made of brass and adapted to keep hold of the hook 10. On the side of a fabric 110 such as of trousers opposite to the side thereof to which the hook 10 and the eye 30 are attached, retainers 20 and 40 made of aluminum (inclusive of aluminum alloy) and adapted to fix the hook 10 and the eye 30 respectively are disposed, as shown in FIG. 1 and FIG. 6.

As shown in FIG. 1, the hook 10 has a one-piece body including an upper locking tongue 11, a lower base 13 lying substantially parallel to the locking tongue 11, and an intermediate arcuate portion 12 extending between the locking tongue 11 and the base 13 so as to define therebetween an eye-receiving channel 14 for receiving an upper plate 31 of the eye 30. The base 13 has on opposite lateral edges thereof a pair of engaging prongs 15*a* and 15*b* projecting parallelly and substantially perpendicularly therefrom in a direction away from the locking tongue 11. Each of the engaging prongs 15*a* and 15*b* has a free end part configured as a truncated wedge. The leading end of each engaging prong 15*a* or 15*b* is formed in the shape of a flat part 16*a* or 16*b* lying in a plane substantially perpendicular to a direction of penetration of the engaging prongs 15*a* and 15*b* into the thin-wall parts 24*a* and 24*b* of the retainer 20. That is, the leading end face of each engaging prongs 15*a* or 15*b* is formed in a flat surface substantially perpendicular to a longitudinal direction thereof, as best shown in FIG. 4.

Figure 3:
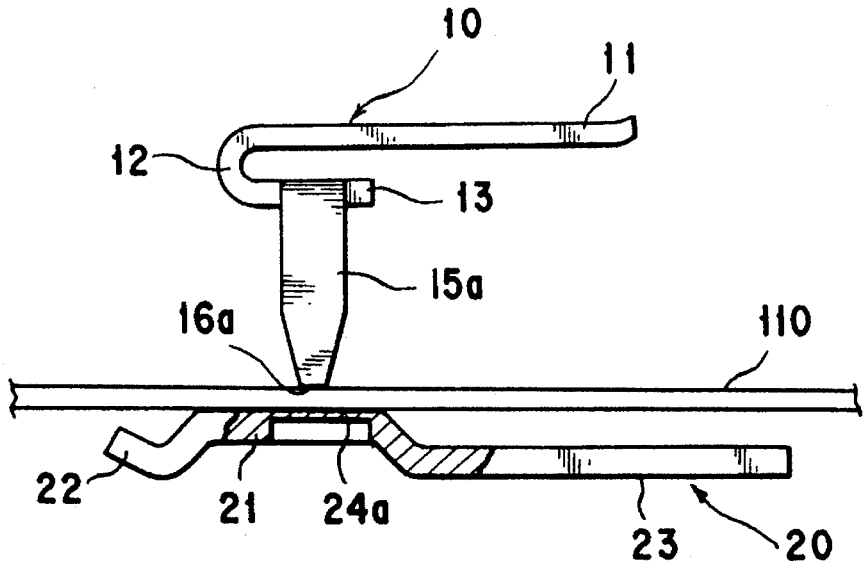
FIG. 3 is a partially sectioned side view illustrating the hook and the retainer of the hook-and-eye fastener of the same embodiment in the state ready for attachment to a fabric.

The retainer 20 has a central raised portion 21 extending throughout the width of the retainer, an upwardly bent rear portion 22 extending rearwardly from the central raised portion 21, and a flat front portion 23 extending forwardly from the central raised portion 21. The central raised portion 21 serves as a support for the base 13 of the hook 10. The retainer 20 has in the central raised portion 21 thereof a pair of thin-wall parts 24*a* and 24*b* to be pierced respectively by the pair of engaging prongs 15*a* and 15*b* of the hook 10. Therefore, the distance between the thin-wall parts 24*a* and 24*b* is substantially corresponding to that between the engaging prongs 15*a* and 15*b* of the hook 10. These thin-wall parts 24*a* and 24*b* are formed by pressing two prescribed parts of the central raised portion 21 of the retainer 20 to a thickness small enough to be pierced by the flat parts 16*a* and 16*b* at the leading ends of the engaging prongs 15*a* and 15*b* when these flat parts 16*a* and 16*b* collide against and pierce the thin-wall parts 24*a* and 24*b*. As best shown in FIG. 3, each thin-wall part 24*a* or 24*b* of the retainer 20 has an upper surface lying flush with an upper surface of the retainer and a lower concave surface.

As shown in FIG. 6, the eye 30 is likewise provided with a pair of engaging prongs 32*a* and 32*b* projecting substantially perpendicularly from opposite lateral edges of an upper plate 31. These engaging prongs 32*a* and 32*b*, similarly to those of the hook 10, have free end parts configured as a truncated wedge whose leading end face 33*a* or 33*b* is formed in a flat surface substantially perpendicular to a longitudinal direction thereof and are so disposed as to pierce the thin-wall parts 44*a* and 44*b* formed in the retainer 40 for the eye 30. The retainer 40 has a central raised portion 41 in which the pair of thin-wall parts 44*a* and 44*b* are formed and upwardly bent portions 42 and 43 extending from the both sides of the central raised portion 41.

To attach the hook 10 of the hook-and-eye fastener 1 of this embodiment to the fabric 110, first the retainer 20 is set at a prescribed position on the side of the fabric 110 opposite to the side thereof on which the hook 10 is to be set in place. Then, the engaging prongs 15*a* and 15*b* of the hook 10 are pressed across the fabric 110 against the thin-wall parts 24*a* and 24*b* of the retainer 20 until the engaging prongs 15*a* and 15*b* completely pierce the thin-wall parts 24*a* and 24*b*. Thereafter, by means of a suitable punch-and-die unit (not shown), the engaging prongs 15*a* and 15*b* are bent inwardly toward each other on the reverse surface side of the retainer 20 to join the hook 10 to the retainer 20 infallibly, as shown in FIG. 5. The hook 10 and the retainer 20 thus attached together to the fabric 110 disposed therebetween constitute a hook engageable with the eye attached to another fabric. The attachment of the eye 30 of the hook-and-eye fastener 1 to the fabric 110 is carried out in the same manner as that of the hook 10 described above.

When the engaging prongs 15*a* and 15*b* (or 32*a* and 32*b*) of the hook 10 (or eye 30) are on the verge of piercing the thin-wall parts 24*a* and 24*b* (or 44*a* and 44*b*) of the retainer 20 (or 40), the flat parts 16*a* and 16*b* (or 33*a* and 33*b*) at the leading ends of the engaging prongs 15*a* and 15*b* (or 32*a* and 32*b*) of the hook 10 (or eye 30) come into surface contact across the fabric 110 with the relevant retainer 20 (or 40) and the flat parts 16*a* and 16*b* (or 33*a* and 33*b*) at the leading ends of the engaging prongs 15*a* and 15*b* (or 32*a* and 32*b*) in the state described above are forced through the thin-wall parts 24*a* and 24*b* (or 44*a* and 44*b*) of the retainer 20 (or 40). At the time that the engaging prongs 15*a* and 15*b* (or 32*a* and 32*b*) of the hook 10 (or eye 30) pierce the thin-wall parts 24*a* and 24*b* (or 44*a* and 44*b*) of the retainer 20 (or 40), therefore, the fabric 110 is cut in the plane or line of contact between the flat parts 16*a* and 16*b* (or 33*a* and 33*b*) or edges thereof at the leading ends of the engaging prongs 15*a* and 15*b* (or 32*a* and 32*b*) and the thin-wall parts 24*a* and 24*b* (or 44*a* and 44*b*) of the retainer 20 (or 40). Subsequently, when the engaging prongs 15*a* and 15*b* (or 32*a* and 32*b*) are to be inserted into the through holes formed in the thin-wall parts 24*a* and 24*b* (or 44*a* and 44*b*) by the engaging prongs 15*a* and 15*b* (or 32*a* and 32*b*), the leading ends of the engaging prongs 15*a* and 15*b* (or 32*a* and 32*b*) neither catch hold of threads of the fabric 110 and drag them into the through holes nor impart wrinkles to the fabric 110. The attachment of the hook-and-eye fastener to the fabric, therefore, can be attained infallibly without imparting wrinkles to the fabric even when the fabric is made of threads of silk or the so-called new synthetic fibers which have a particularly small diameter.

Since in the aforementioned embodiment the retainers 20 and 40 are made of aluminum, the retainers 20 and 40 themselves and the thin-wall parts 24*a*, 24*b*, 44*a* and 44*b* thereof can be easily formed. Further, the engaging prongs 15*a*, 15*b*, 32*a* and 32*b* of the hook 10 and the eye 30 having the flat parts 16*a*, 16*b*, 33*a* and 33*b* at the leading ends thereof are allowed to pierce the thin-wall parts 24*a*, 24*b*, 44*a* and 44*b* of the retainers 20 and 40 with ease. The hook-and-eye fastener is possessed of ample strength.

The invention may be embodied in other specific forms without departing from the spirit or essential characteristics thereof. For instance, the engaging prongs 15*a*, 15*b*, 32*a* and 32*b* of the hook-and-eye fastener of the present invention are only required to be so shaped as to have flat parts 16*a*, 16*b*, 33*a* and 33*b* at the leading ends thereof. The area and shape of these flat parts may be freely set so as to fit the material and thickness of the fabric 110 and the purpose for which the hook-and-eye fastener is to be used. The upwardly bent rear portion 22 of the retainer 20 may have a free end lying flush with the upper surface of the central raised portion 21 so that the free end of the upwardly bent rear portion 22 and the central raised portion 21 sufficiently bite into the garment fabric 110 to any relative movement between the retainer 20 and the fabric 110. Similarly, the upwardly bent portions 42 and 43 of the retainer 40 for the eye 30 may have a free end lying flush with the upper surface of the central raised portion 41.

The described embodiments are therefore to be considered in all respects as illustrative and not restrictive, the scope of the invention being indicated by the appended claims rather than by foregoing description and all changes which come within the meaning and range of equivalency of the claims are, therefore, intended to be embraced therein.

What is claimed is:

1. A hook-and-eye fastener, comprising:

fastener members comprising a hook and an eye, each member having a pair of engaging prongs projecting substantially perpendicularly therefrom; and retainers adapted severally to immobilize said fastener members and intended to be disposed on the side of a fabric opposite to the side thereof on which said fastener members are set in place;

each of said retainers having a pair of thin-wall parts adapted to be pierced by said pair of engaging prongs of the relevant fastener member, each thin-wall part of said retainers having a means for contacting the fabric comprising an upper surface lying flush with an upper surface of the retainer and a lower concave surface, and leading ends of said engaging prongs of each fastener member being formed in the shape of a flat part lying in a plane substantially perpendicular to a direction of penetration of said engaging prongs into said thin-wall parts of the relevant retainer through first the upper surface and then the lower concave surface of the thin-wall parts of said retainers.

2. A hook-and-eye fastener according to claim 1, wherein said fastener members are made of a metal and said retainers are made of aluminum or aluminum alloy.

3. A hook-and-eye fastener according to claim 1, wherein each of said engaging prongs of the fastener members has a free end part configured as a truncated wedge.

4. A hook-and-eye fastener according to claim 1, wherein said hook has a one-piece body including a base, a locking tongue lying substantially parallel to said base, and an intermediate arcuate portion extending between said base and said locking tongue so as to define therebetween an eye-receiving channel, said base having on opposite lateral edges thereof a pair of engaging prongs projecting substantially perpendicularly therefrom in a direction away from said locking tongue, each of said engaging prongs having a free end part configured as a truncated wedge.

5. A hook-and-eye fastener according to claim 1, wherein said eye includes an upper plate and a pair of engaging prongs projecting substantially perpendicularly from opposite lateral edges of said upper plate, each of said engaging prongs having a free end part configured as a truncated wedge.

6. A hook-and-eye fastener, comprising in combination:

a hook having a one-piece body including a base, a locking tongue lying substantially parallel to said base, and an intermediate arcuate portion extending between said base and said locking tongue so as to define therebetween an eye-receiving channel, said base having on opposite lateral edges thereof a pair of engaging prongs projecting substantially perpendicularly therefrom in a direction away from said locking tongue, each of said engaging prongs having a free end part configured as a truncated wedge whose leading end face is formed in a flat surface substantially perpendicular to a longitudinal direction thereof;

an eye adapted to keep hold of said hook and including an upper plate and a pair of engaging prongs projecting substantially perpendicularly from opposite lateral edges of said upper plate, each of said engaging prongs having a free end part configured as a truncated wedge whose leading end face is formed in a flat surface substantially perpendicular to a longitudinal direction thereof; and retainers adapted severally to immobilize said hook and eye, each of said retainers having a pair of thin-wall parts adapted to be pierced by said pair of engaging prongs of the relevant hook and eye, each thin-wall part of said retainers having a means for contacting the fabric comprising an upper surface lying flush with an upper surface of the retainer and a lower concave surface wherein the free end parts of said engaging prongs penetrate first the upper surface and then the lower concave surface of the thin-wall parts of said retainers.

7. A hook-and-eye fastener according to claim 6, wherein said hook and eye are made of a metal and said retainers are made of aluminum or aluminum alloy.

8. A hook for a hook-and-eye fastener, comprising in combination:

a hook having a one-piece body including a base, a locking tongue lying substantially parallel to said base, and an intermediate arcuate portion extending between said base and said locking tongue so as to define therebetween an eye-receiving channel, said base having on opposite lateral edges thereof a pair of engaging prongs projecting substantially perpendicularly therefrom in a direction away from said locking tongue, each of said engaging prongs having a free end part configured as a truncated wedge whose leading end face is formed in a flat surface substantially perpendicular to a longitudinal direction thereof; and a retainer adapted to immobilize said hook and having a pair of thin-wall parts adapted to be pierced by said pair of engaging prongs of the hook, which thin-wall part of the retainer having a means for contacting the fabric comprising an upper surface lying flush with an upper surface of the retainer and a lower concave surface wherein the free end parts of said engaging prongs penetrate first the upper surface and then the lower concave surface of the thin-wall parts of said retainer.

9. A hook according to claim 8, wherein said hook is made of a metal and said retainer is made of aluminum or aluminum alloy.

10. An eye for a hook-and-eye fastener, comprising in combination:

an eye including an upper plate and a pair of engaging prongs projecting substantially perpendicularly from opposite lateral edges of said upper plate, each of said engaging prongs having a free end part configured as a truncated wedge whose leading end face is formed in a flat surface substantially perpendicular to a longitudinal direction thereof; and a retainer adapted to immobilize said eye and having a pair of thin-wall parts adapted to be pierced by said pair of engaging prongs of the eye, each thin-wall part of the retainer having a means for contacting the fabric comprising an upper surface lying flush with an upper surface of the retainer and a lower concave surface wherein the free end parts of said engaging prongs penetrate first the upper surface and then the lower concave surface of the thin-wall parts of said retainer.

11. An eye according to claim 10, wherein said eye is made of a metal and said retainer is made of aluminum or aluminum alloy.

* * * * *